US009490599B2

(12) United States Patent
Griffith et al.

(10) Patent No.: US 9,490,599 B2
(45) Date of Patent: Nov. 8, 2016

(54) ELECTRICAL CONNECTION FOR QUICK AND SAFE CONNECTION TO MULTIPLE UNITS

(71) Applicant: Celesta Gail Griffith, Greer, SC (US)

(72) Inventors: Celesta Gail Griffith, Greer, SC (US); Edgar Jack Lail, Greer, SC (US)

( * ) Notice: Subject to any disclaimer, the term of this patent is extended or adjusted under 35 U.S.C. 154(b) by 242 days.

(21) Appl. No.: 13/912,156

(22) Filed: Jun. 6, 2013

(65) Prior Publication Data

US 2014/0033531 A1 Feb. 6, 2014

Related U.S. Application Data

(60) Provisional application No. 61/678,645, filed on Aug. 2, 2012.

(51) Int. Cl.
*H01R 43/26* (2006.01)
*H01R 31/06* (2006.01)

(52) U.S. Cl.
CPC ..... *H01R 31/06* (2013.01); *H01R 43/26* (2013.01); *Y10T 29/49208* (2015.01)

(58) Field of Classification Search
CPC ..... H01R 31/06
USPC ..... 439/502, 501
See application file for complete search history.

(56) References Cited

U.S. PATENT DOCUMENTS 1,665,472 A * 4/1928 Opperman ..... A45D 4/06 132/229
1,924,040 A * 8/1933 Jancke ..... A45D 4/06 219/222
2,060,929 A * 11/1936 de los Santos ..... A45D 1/28 219/222
3,084,700 A * 4/1963 Fischer ..... A45D 24/00 132/148
3,095,523 A * 6/1963 Stith ..... H01R 13/648 361/220
4,210,797 A * 7/1980 Tomaro ..... A45D 1/16 132/232
4,282,954 A * 8/1981 Hill ..... H02G 11/02 191/12.4
4,900,270 A * 2/1990 Edwards ..... H01R 31/06 439/173
4,946,396 A * 8/1990 Saitoh ..... H01R 31/06 439/500

(Continued)

FOREIGN PATENT DOCUMENTS

WO 2011/054106 * 5/2011

*Primary Examiner* — Neil Abrams
(74) *Attorney, Agent, or Firm* — J. Bennett Mullinax, LLC

(57) ABSTRACT

A plurality of tools, such as blow dryers, multiple size curling irons, multiple size flatirons, clipper and trimmers include a substantially shortened electrical cord, with the cord terminating in a connector, such as a male connector. The system also includes a wall cord, having one end that plugs into a standard wall outlet, and another end that is the counterpart of the tool's connector, for example the corresponding female connector. Thus, the system includes a plurality of tools, and at least one wall cord, with the tools all individually capable of connection with the wall cord. The overall length of the tool's cord is desirably approximately 10 feet.

7 Claims, 3 Drawing Sheets

(56) References Cited

U.S. PATENT DOCUMENTS 5,234,360 A * 8/1993 Kramer, Jr. ..... H01R 25/003 439/367
5,547,393 A * 8/1996 Jansen ..... A45D 20/12 132/233
5,573,422 A * 11/1996 Lawliss ..... H01R 13/56 439/445
5,917,694 A * 6/1999 Denny ..... A45D 1/00 206/372
5,970,622 A * 10/1999 Bahman ..... A45D 20/00 34/97
6,007,373 A * 12/1999 Chew ..... H01R 13/6675 439/500
6,043,457 A * 3/2000 Hashimoto ..... A45D 26/0009 132/118
6,305,388 B1 * 10/2001 Zeller ..... A45D 44/02 132/287
6,581,890 B2 * 6/2003 Johnson ..... A45D 44/04 248/161
6,703,587 B2 * 3/2004 Sena ..... A45D 1/20 132/211
6,769,554 B1 * 8/2004 Udofiah ..... A45D 44/06 211/26.2
7,025,616 B2 * 4/2006 Hopper ..... H01R 13/625 439/318
7,168,538 B2 * 1/2007 Pena ..... H02G 11/02 191/12.2 R
7,209,038 B1 * 4/2007 Deconinck ..... G08B 13/1409 340/541
7,279,640 B2 * 10/2007 White ..... B60D 1/62 174/135
7,472,455 B2 * 1/2009 Dolton ..... A45D 44/04 15/323
7,513,361 B1 * 4/2009 Mills, Jr. ..... A45D 44/00 132/315
7,534,136 B2 * 5/2009 Bova ..... H01R 13/60 248/317
7,798,845 B1 * 9/2010 Buchanan ..... H01R 13/6397 439/502
8,132,571 B1 * 3/2012 Jackson ..... A45D 1/04 132/211
8,215,962 B1 * 7/2012 Machado ..... H01R 24/58 439/18
8,834,209 B2 * 9/2014 Conrad ..... H01R 13/6456 439/680
2014/0033531 A1 * 2/2014 Griffith ..... H01R 31/06 29/876

* cited by examiner

ELECTRICAL CONNECTION FOR QUICK AND SAFE CONNECTION TO MULTIPLE UNITS

CROSS-REFERENCE TO RELATED APPLICATION

This application claims the benefit of priority of U.S. provisional application No. 61/678,645, filed Aug. 2, 2012, the contents of which are herein incorporated by reference.

BACKGROUND OF THE INVENTION

The present invention relates to electrical connectors and, more particularly, to a push-pull electrical connection allowing multiple units, such as multiple beauty salon accessories, to connect to a single power cord, thereby reducing the number of cords at a beauty salon station, increasing efficiency and safety.

Hair cutters and stylists have a limited amount of workspace and a wide variety of electrical tools that may be needed at various times. The specific tools needed by a particular client can vary. For example, a stylist may need a blow dryer and flatiron on one client, clippers on the next client, and a blow dryer and curling iron on the third. As a result a stylist has many tools, and many dangling cords, cluttering their area. This arrangement is inconvenient, unattractive and dangerous.

Moreover, when each piece of equipment is used and later stored, the stylist often wraps the cord around the tool for safe and compact storage. When the tool is needed again, the cord is unwrapped and then re-wrapped for storage after use. Repeated use and storage can break or cause an electrical short in the power cord.

As can be seen, there is a need for a system whereby a stylist can drastically decrease the number of electrical cords in their area. It is desirable that this system is easy to use, safe, and decreases clutter. It is also desirable that the tools are interchangeable insofar as a stylist can add tools to their collection, and/or use another stylist's tools, and those tools will also work with the system.

SUMMARY OF THE INVENTION

In one aspect of the present invention, an electrical power cord system for supplying power to a plurality of tools comprises a wall cord; a wall socket plug at a first end of the wall cord; a first electrical connector at a second end of the wall cord; a tool cord on each of the plurality of tools; and a second electrical connector, disposed on the tool cord to mate with the first electrical connector such that power is transferred from the wall socket plug to the tool.

In another aspect of the present invention, an electrical power cord system comprises a plurality of electric beauty salon tools; a tool cord extending from each of the plurality of electric beauty salon tools, the tool cord being less than about 12 inches in length; a first connector disposed on the end of each of the tool cords; a wall cord; a wall socket plug at a first end of the wall cord; and a second electrical connector at a second end of the wall cord mating with the first electrical connector such that power is transferred from the wall socket plug to the tool.

In a further aspect of the present invention, a method for using beauty salon tools without the need for each of the beauty salon tools to be directly and separately plugged into a wall receptacle comprises selecting one of the beauty salon tools for use; plugging a first connector disposed on a tool cord of the selected one of the beauty salon tools into a second connector disposed on a first end of a wall cord, the second end of the wall cord having a wall socket plug; disconnecting the first connector from the second connector when finished using the selected one of the beauty salon tools; and storing the selected one of the beauty salon tools, where the tool cord is sufficiently short to not require wrapping about the body of the beauty salon tool.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a system wherein a plurality of tools, such as blow dryers, multiple size curling irons, multiple size flatirons, clipper and trimmers include a substantially shortened electrical cord, with the cord terminating in a connector, such as a male connector. The system also includes a wall cord, having one end that plugs into a standard wall outlet, and another end that is the counterpart of the tool's connector, for example the corresponding female connector. Thus, the system includes a plurality of tools, and at least one wall cord, with the tools all individually capable of connection with the wall cord. The overall length of the tool's cord is desirably approximately 10 feet.

Various connectors can be used to connect the tools to the wall cord, typically, the connectors are push-pull connectors. One suitable connector is the ODU Mini-Snap PC Connector, model numbers S22A18-P03MSN9-750S and K22A18-P03LSN9-750S, which is commercially available from ODU of Camarillo, Calif. The connectors can also include a silicone bend sleeve strain relief, available as 702-023-208-965-060 silicone from ODU of Camarillo, Calif., for example.

In use, a stylist at a workstation would have a limited number of wall cords, and a plurality of tools, and would plug in only the tools that they need. In this manner, unused tools can be easily stowed or left on the workspace counter, without creating a tangle of dangerous and unsightly cords. When the stylist is finished with one tool they turn it off and unplug the connector, thereby freeing up the wall cord for subsequent tool plug-in and use.

Figure 1:
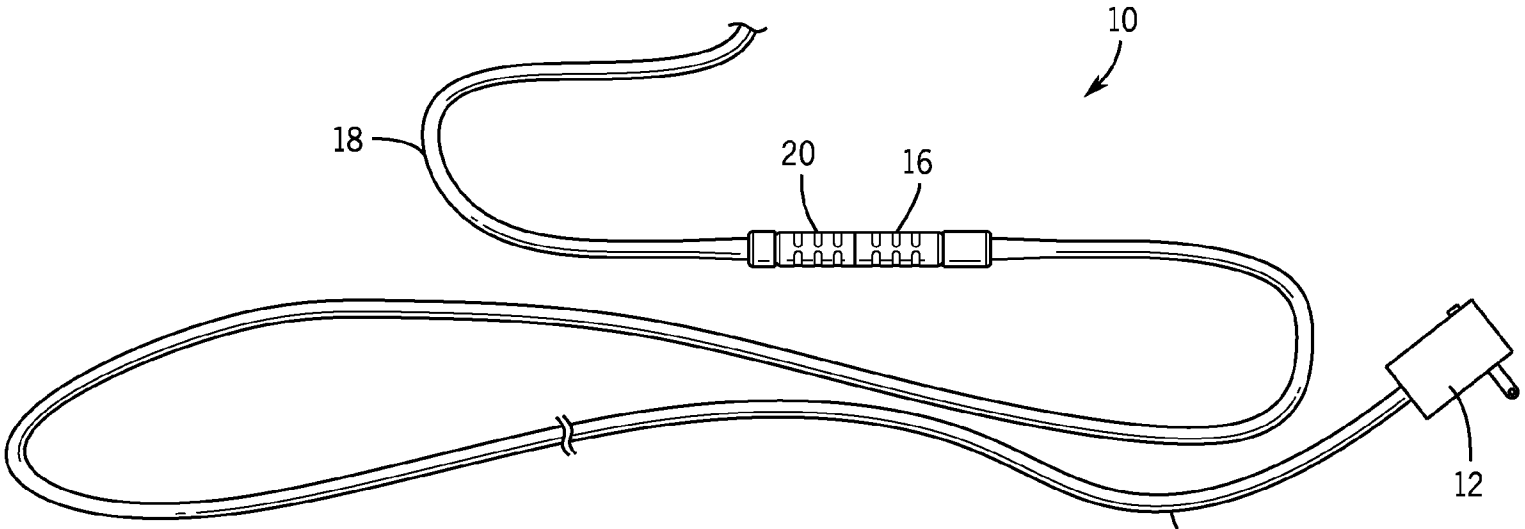
FIG. 1 is a perspective view of a power cord having a push-pull electrical connection system according to an exemplary embodiment of the present invention.
Figure 2:
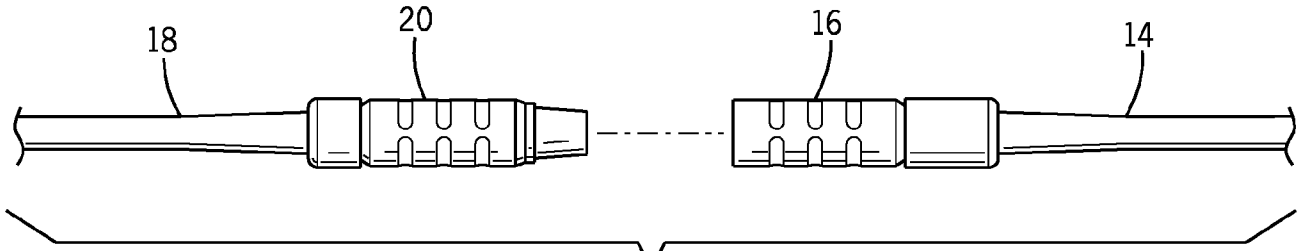
FIG. 2 is a detailed side view of the electrical connection of FIG. 1.
Figure 3:
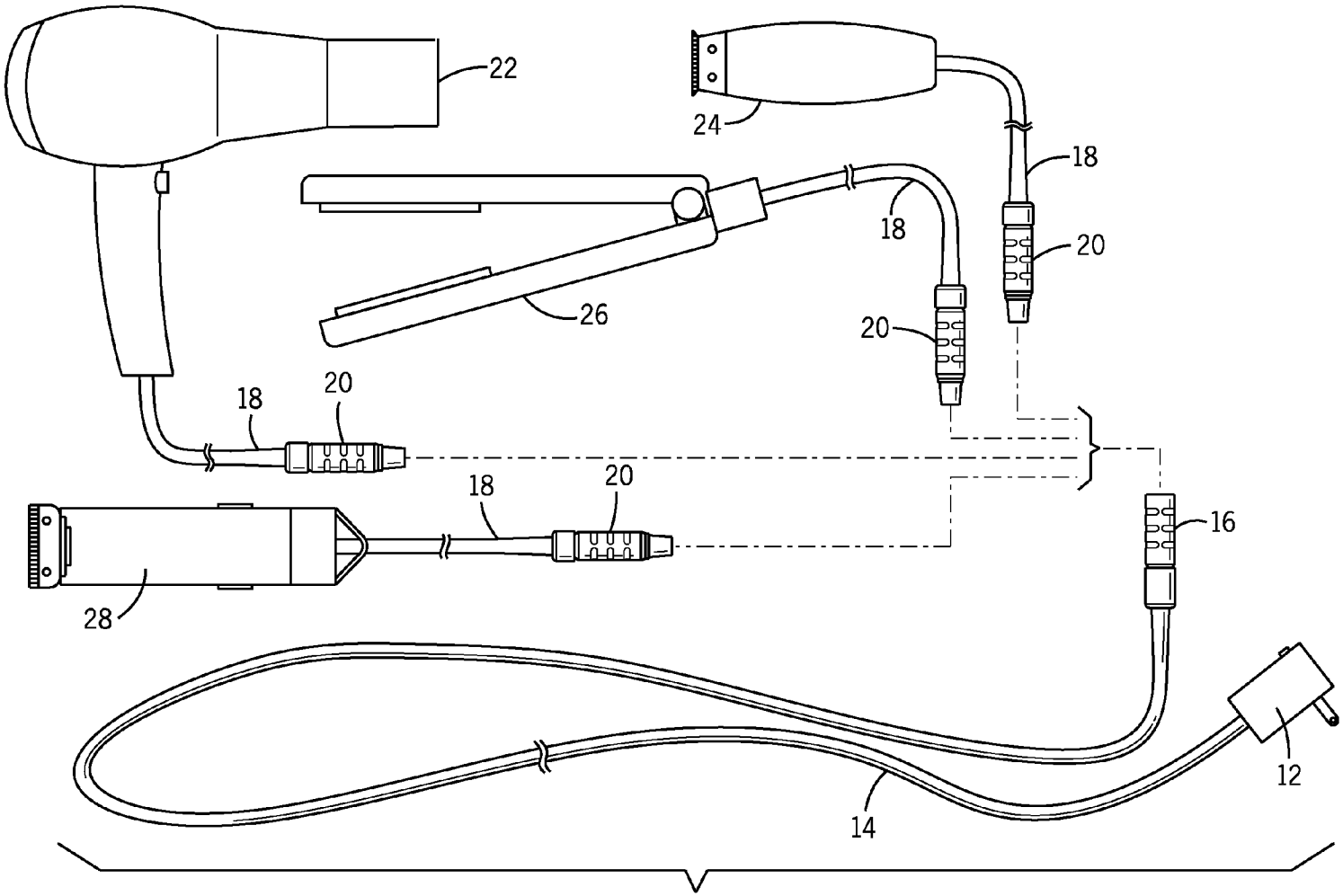
FIG. 3 is a beauty salon set of tools, each having an electrical connection to fit into the cable of FIG. 1.

Referring now to FIGS. 1 through 3, a cord system 10 includes a wall cord 14 having a wall socket plug 12 disposed on one end thereof and a connector 16 disposed on one end thereof. A tool cord 18 can attach to a tool, such as a blow dryer 22, a shaver 24, a straightening iron 26, a hair clipper 28 or the like, on a first end thereof and can include a mating connector 20 disposed on a second end thereof. Typically, the tool cord 18 is a short cord, extending less than about 12 inches from the tool. The wall cord 14 can be any suitable length, typically from about 8 to about 12 feet in length. The tools can be stored in a single, compact container without having the cords dangerously dangling or being wrapped around the tool.

Figure 4:
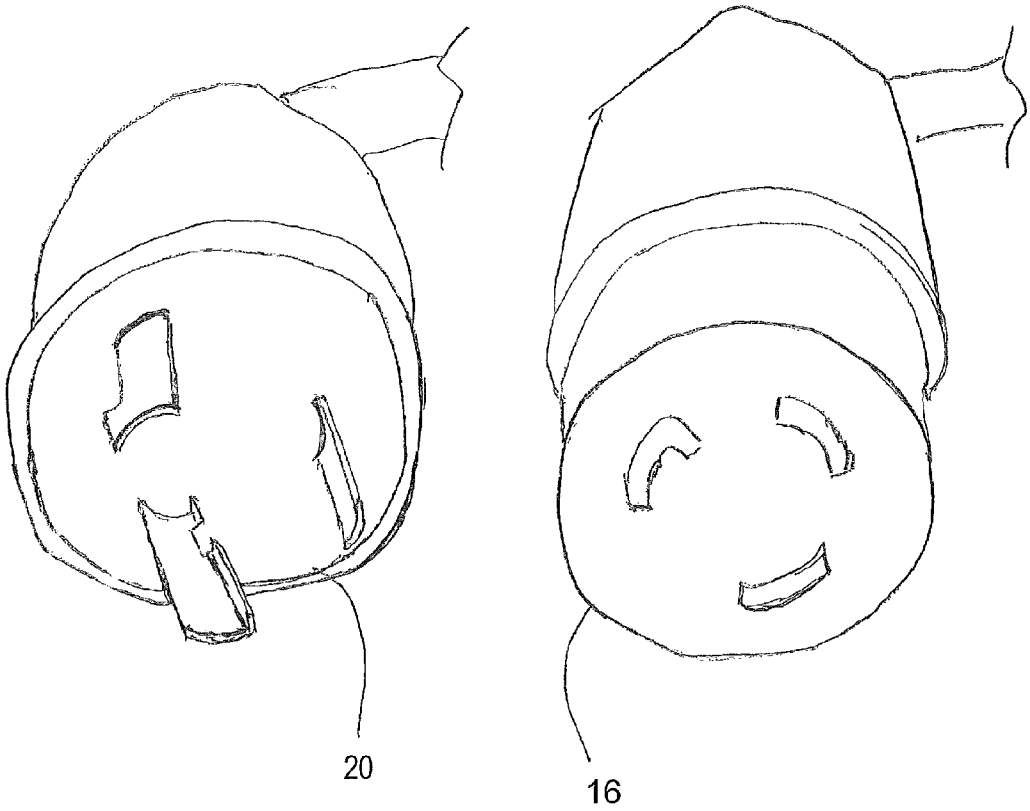
FIG. 4 is a perspective view of connectors of a power cord that together form an electrical connection according to an exemplary embodiment of the present invention.

Typically, the connector 16 can be a female connector and the mating connector 20 can be a male connector, however, an opposite configuration can be used within the scope of the present invention. Moreover, any suitable separable electrical connection can be realized between connector 16 and mating connector 20, provided that electrical current can flow from the wall cord 14 to the tool cord 18. Typically, the connector 16 and the mating connector 20 can be connected and disconnected in a push-pull manner. In some embodiments, the connector 16 and the mating connector 20 can connect with a twist-lock type of connection as shown in FIG. 4.

In some embodiments, an extension cord (not shown), having the connector 16 on one end and the mating connector 20 on the other end, can be used to adjust the overall length of the cord from the wall socket plug 12 to the tool. This design can allow for custom length drop cords lengths and solves the problem of a drop cord that is too long.

The connector 16 and the mating connector 20 can include a rubber or other anti-slip coating to assist the user in connecting and disconnecting the connectors 16, 20.

While the above description and drawings refer to beauty salon tools that can benefit from the system of the present invention, the power cord system can be used for various trades where multiple tools are used at various times.

It should be understood, of course, that the foregoing relates to exemplary embodiments of the invention and that modifications may be made without departing from the spirit and scope of the invention as set forth in the following claims.

What is claimed is:

1. An electrical power cord system for supplying power to a plurality of electric beauty salon tools, comprising:

a wall cord;

a wall socket plug at a first end of the wall cord;

a first electrical connector at a second end of the wall cord, the first electrical connector configured to not engage a wall outlet;

a tool cord on each of the plurality of electric beauty salon tools; and a second electrical connector disposed on each of the tool cords, each of the second electrical connectors configured to not engage a wall outlet and each of the second electrical connectors configured to lockingly mate with the first electrical connector such that power is transferred from the wall socket plug to the respective tool when the second electric connector of the tool cord of the respective tool is mated with the first electrical connector.

2. The electrical power cord system of claim 1, wherein the tool cord is less than about 12 inches in length.

3. The electrical power cord system of claim 1, wherein the second electrical connector is a male connector and the first electrical connector is a female connector.

4. The electrical power cord system of claim 1, wherein the first electrical connector and the second electrical connector comprise push-pull connectors that are connected and disconnected with a push-pull action.

5. The electrical power cord system of claim 1, wherein the first electrical connector and the second electrical connector comprise twist-lock connectors.

6. An electrical power cord system comprising:

a plurality of electric beauty salon tools;

a tool cord extending from each of the plurality of electric beauty salon tools, each of the tool cord being less than about 12 inches in length;

a first push-pull connector disposed on the end of each of the tool cords with the first push-pull connector configured not to mate with a wall socket;

a wall cord;

a wall socket plug at a first end of the wall cord; and a second push-pull connector at a second end of the wall cord configured to mate with the first push-pull connector of the tool cord of each of the tools such that each of the first electrical connectors of the tool cords of the respective electric beauty salon tools is configured to lockingly mate with the second electrical connector and power is transferred from the wall socket plug to the tool when the first push-pull connector of the tool cord of the respective tool is mated with the second push-pull connector.

7. The electrical power cord system of claim 6, wherein the first electrical connector is a male connector and the second electrical connector is a female connector.

* * * * *